United States Patent [19]

Brown

[11] Patent Number: 4,845,839

[45] Date of Patent: Jul. 11, 1989

[54] METHOD OF MAKING A RESISTIVE ELEMENT

[75] Inventor: Kenneth Brown, Alto Loma, Calif.

[73] Assignee: Hamilton Standard Controls, Inc., Farmington, Conn.

[21] Appl. No.: 264,588

[22] Filed: Oct. 31, 1988

[51] Int. Cl.[4] ..... H01C 17/06

[52] U.S. Cl. ..... 29/620; 29/846; 29/847; 427/101; 427/103; 338/162; 264/156; 264/162; 264/272.18

[58] Field of Search ..... 29/620, 846, 847; 427/101, 103; 338/308, 312, 313, 162; 264/154, 156, 272.18, 316

[56] References Cited

U.S. PATENT DOCUMENTS

| | | | |
|---|---|---|---|
| 3,518,756 | 7/1970 | Bennett et al. | 29/620 |
| 3,655,496 | 4/1972 | Ettre et al. | 338/308 |
| 3,673,539 | 6/1972 | Healy et al. | 338/308 |
| 4,015,231 | 3/1977 | Seno et al. | 338/312 |
| 4,112,250 | 9/1978 | Moffitt et al. | 338/308 |
| 4,554,732 | 11/1985 | Sadlo et al. | 29/620 |

FOREIGN PATENT DOCUMENTS

| | | | |
|---|---|---|---|
| 378818 | 2/1940 | Italy | 338/308 |

*Primary Examiner*—P. W. Echols

[57] ABSTRACT

A method is described for providing electrically resistive elements for mounting in an electrical resistor device for engagement with a relatively movable contact member, as in a potentiometer. A pair of termination openings are formed through a substrate of insulating material such as plastic film. A release liner is applied to the undersurface of the substrate to cover the openings. An electrically conductive medium is applied in fluid (paste) form to the top surface of the substrate and is caused to fill the termination openings, as by applying pressure. The conductive medium is solidified and the release liner is removed. A resistive medium for ultimate engagement with the movable contact is applied to the top surface of the substrate in engagement with the termination openings. The resistive track is shaped as desired, either linear or an annular segment, preferably as part of final shaping steps which also remove the resistive element from a continuous strip of the substrate material. The resultant shape of the resistive track includes the conductor-filled termination openings under opposite ends thereof. The resistive element may then be affixed to a more rigid substrate, with its pair of termination openings in alignment and conductivity joined to a respective pair of termination pads on the more rigid substrate.

12 Claims, 1 Drawing Sheet

METHOD OF MAKING A RESISTIVE ELEMENT

CROSS REFERENCE TO RELATED APPLICATION

This application is related to U.S. Ser. No. 07/264,605 for Resin Composition by Kenneth Brown, filed on even date herewith.

TECHNICAL FIELD

The invention relates to a method for making an electrically resistive element and the terminations therefor. The invention further relates to the product made by such method. Still further, the invention relates to a method for making electrically resistive elements for mounting in an electrically resistive device for engagement with a relatively movable contact member, as for instance within a potentiometer.

BACKGROUND ART

Considerable development has occurred with respect to electrically resistive elements, and particularly those suited for mounting in an electrical resistor device, such as a potentiometer, and adapted to be in engagement with a relatively movable contact member. Typically, a resistive element is affixed to some form of substrate is mounted within a potentiometer housing, and a rotatable or translatable contact member is in relatively movable engagement with the resistive element.

In recent years, a variety of materials and techniques have been developed for providing resistive coatings on a nonconductive substrate. In fact, certain conductive plastics have been employed to provide the resistance elements which are then mounted on a supporting substrate. Those conductive plastics typically incorporate carbon particles mixed within a thermosetting resin matrix to provide the conductive plastic resistance element. In some instances, that plastic resistance element may be of a fairly rigid form and in others, such as typified by U.S. Pat. No. 3,457,537, it may take the form of a flexible film which, in turn, is fixed in some manner to a rigid supporting structure.

Most typically, the conductive plastic resistance element is either directly connected to pre-deposited terminal elements or, as depicted in the aforementioned U.S. Pat. No. 3,457,537, employs rigid electrical contacts of a rivet shape which additionally serve to affix the resistive element to its respective substrate.

In those arrangements, the termination elements typically interrupt the otherwise smooth surface of the resistive element along which a movable wiper or contact travels. Because of the perturbations occasioned by such termination means, the wiper is either restricted in its movement beyond those points or may experience unwanted discontinuities in those regions and/or experiences excessive wear. Such interference between the wiper contact and the terminals associated with the resistance element have a similarly deleterious effect on the resistive element.

Certain processes and products associated with the field of electrical components and structures have given particular attention to arrangements for their termination. In one instance, typified by U.S. Pat. No. 4,554,732, provision is made for side-termination on discrete resistors comprised of a resistive film on a ceramic substrate. However, such resistors are not contemplated for use in engagement with a movable wiper contact.

Still further, U.S. Pat. No. 3,518,756 discloses a processes for fabricating a multi-level ceramic microelectronic structure in which various sheets are provided with via holes, electrode paste is deposited in those via holes and the sheets are then bonded together into a monolithic structure. Separate terminal holes will have been preformed in the several sheets such that upon final assembly, contact pins may be embedded in the terminal holes. However, that structure is rather complex in its assembly, it requires the insertion of rigid conductor pins and in any event is not intended for use in a potentiometric sense in which a movable contact or wiper is in engagement therewith.

Accordingly, it is a principal object of the invention to provide an improved method for making an electrically resistive element for mounting in an electrical resistor device and being of the type adapted for engagement with a relatively movable contact member. Included within this object are the provision of such an electrically resistive element and the method for its manufacture which result in an electrical resistor device product having high precision and relatively long life.

A further object of the invention is the provision of a method of making an electrically resistive element and the terminations therefor in such manner as to present little or no mechanical interference with a contact member moving in proximity therewith.

It is a still further object of the invention to provide a novel electrically resistive element manufactured in accordance with the method of the invention.

DISCLOSURE OF THE INVENTION

According to the invention there is provided a method for making an electrically resistive element for mounting in an electrical resistor device for engagement with a relatively movable contact member. Broadly, the method comprises the steps of forming a pair of termination openings extending through a substrate of insulating material between the opposite top and undersurfaces thereof; applying a release liner to the undersurface of the substrate; applying an electrically conductive medium, in fluid form, to the top surface of the substrate in sufficient quantity and in such manner as to insure filling the termination openings; applying a resistive coating to the top surface of the substrate, such that the resistive coating covers an area including both of the termination openings and is in contact with the electrically conductive medium; removing the release liner from the undersurface of the substrate sufficiently to expose the conductive medium in the termination openings in the undersurface; and shaping the resistive coating to provide a continuous resistive track having the pair of termination openings thereunder, typically near respectively opposite ends thereof. The resistor track is adapted for engagement with a relatively movable contact member or wiper.

The substrate may be a plastic sheet and the step of forming the pair of termination openings in the substrate consists of either mechanically punching or laser piercing the plastic sheet. The electrically conductive medium comprises conductive particles in a fluid vehicle, and the step of applying the conductive medium to the substrate is followed by a further thermal curing step which causes the conductive medium in the termination openings to assume a substantially solid form. The release liner is removed preferably entirely from the substrate to expose the conductive medium in the termination openings. The resistive coating is applied to a first area of the top surface of the substrate, and the shaping of the resistive coating to provide the resistive track comprises physically separating from that first area at least that part of the substrate and resistive coating which define the resistive track.

The resistive track may be linear or curved. In one embodiment, the resistive track is an annular segment, typically of less than 360°, and the separating step typically removes a 360° annular portion of the substrate and resistive coating. A further step, typically occurring prior to the aforementioned separating step, involves breaking the electrical continuity of the 360° annular resistive coating in order to provide the resistive track of less than 360°. That break in electrical continuity may be accomplished by mechanical or laser cutting at least the resistive coating and perhaps also the substrate.

In a preferred method of the invention, the substrate is a plastic film which is dispensed in continuous strip form. Most of the aforementioned steps are performed on the plastic film substrate while it remains in strip form, including the formation of successive pairs of termination openings, the filling of the termination openings with the conductive medium, the application of the resistive coating as a substantially continuous strip to the top surface of the film, and the removal of the release liner strip from the plastic film. The earlier mentioned step of separating the substrate and resistive coating defining the resistive track from a first area of the substrate correspondingly serves to separate the resistive element from the continuous strip of plastic film.

The invention may be deemed to include the further step of affixing the plastic film substrate having the resistive track to a further rigid substrate. That further substrate is typically electrically nonconducting and has a pair of separate electrically-conductive terminal portions formed thereon and arranged for respective conductive connection with the conductive medium in the respective termination openings in the plastic film substrate. Also included is the further step of conductively connecting the terminal portions on the rigid substrate with the conductive medium in the respective termination openings in the plastic film substrate, as by selectively applying a conductive adhesive therebetween. Though the conductive adhesive might be further used to affix the plastic film substrate generally to the rigid substrate, a preferred alternate arrangement relies upon a pressure sensitive adhesive film applied to the undersurface of the plastic film substrate, typically while it is in continuous strip form, The invention further includes an electrically resistive element manufactured in accordance with the foregoing method and typically providing a resistive track disposed upon a plastic film substrate and including electrically-conductive terminal portions extending from the resistive track through the film substrate for further electrical connection, as to terminal pads on a rigid substrate. The electrical resistor device in which the electrically resistive element is incorporated typically takes the form of a potentiometer or the like.

BEST MODE FOR CARRYING OUT THE INVENTION

Figures 1, 2, 3:
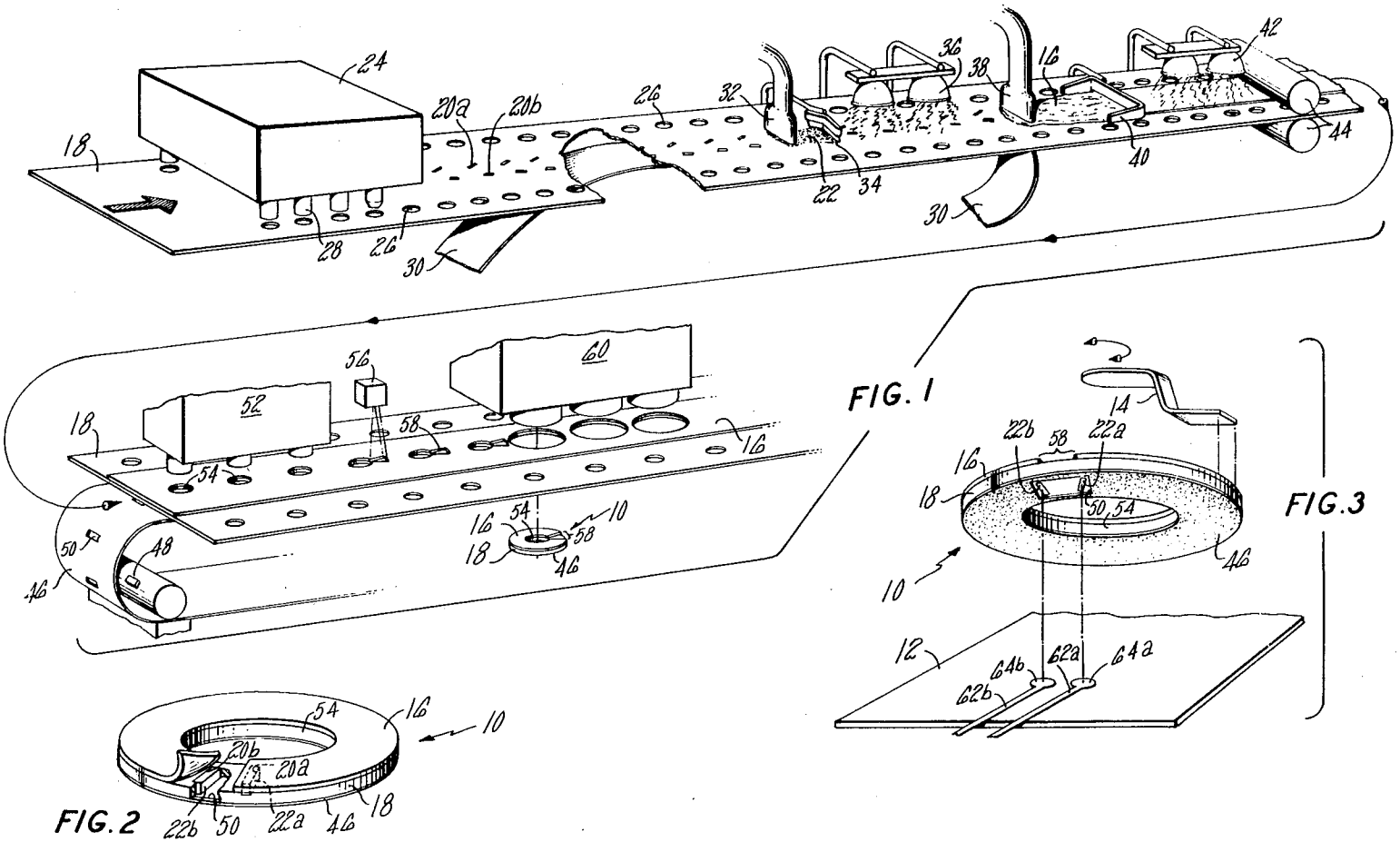
FIG. 1 is a schematic diagram illustrating the formation of electrically resistive elements in accordance with the method of the invention.
FIG. 2 is a perspective view of an electrically resistive element, partly broken away and partly in section, formed in accordance with the invention.
FIG. 3 is an exploded perspective view of an electrically resistive element as in FIG. 2 and disposed for mounting on a subsrate for engagement with a wiper contact, as in a potentiometer.

Referring to the figures collectively, there is schematically depicted in FIG. 1 the method for manufacturing an electrically resistive element 10, best seen in FIG. 2. The element 10 may subsequently be mounted on a terminal-bearing substrate 12 for operative engagement with a movable contact or wiper 14, as for use in a resistor device such as a precision potentiometer, the remaining portions of which are not shown.

Referring briefly to FIG. 2, resistive element 10 in a preferred embodiment comprises an annular segment or track of resistive material 16 disposed on an annular, or near annular, substrate 18. Element 10 includes a pair of termination openings 20*a* and 20*b* (collectively 20) extending through substrate 18 from the top surface to the undersurface thereof and including therein a suitable electrically conductive material 22*a*, 22*b* (collectively 22) for providing electrical connection from the opposite ends of the track of resistive material 16 to some further conductive elements.

Referring to FIG. 1, the substrate 18 is preferably dispensed in a continuous strip form to permit subsequent steps of the manufacturing process to be performed thereon. Substrate strip 18 is electrically nonconductive, is sufficiently deformable to permit some degree of turning and bending to facilitate the manufacturing process, and has an acceptable degree of thermal resistance to the temperatures experienced during the manufacturing process and ultimate utilization of the resistive element. In the preferred embodiment, substrate 18 is a plastic film, and preferably a polyimide resin (e.g., as sold under the trademark "Kapton"). The substrate strip 18 is characterized by chemical inertness and a high temperature stability (e.g., in the range from about (−)100° F. to (+)500° F.). For requisite flexibility of the substrate strip 18 during manufacturing, it preferably has a thickness in a range between about 0.5 mils and 5 mils.

The substrate strip 18 is first caused to pass a piercing station, generally represented by piercing apparatus 24, for receiving sprocket or drive openings 26 aligned near the opposite edges thereof. The sprocket openings 26 may be circular, rectangular or of any other conventional form for engagement with a drive sprocket (not shown).

Importantly to the invention, piercing apparatus 24 also provides the pairs of termination openings 20*a*, 20*b* mentioned earlier. The termination openings extend entirely through the substrate strip 18 from its top surface to its undersurface. The termination openings 20, though depicted herein as being of rectangular form, might be of alternative geometries, including circular. For the depicted rectangular geometry of termination openings 20, each has a width of about 0.020 inch and a length of about 0.050 inch.

The sprocket openings 26 and the termination openings 20 may be provided by a mechanical punching or cutting operation or alternatively, by a laser piercing or cutting operation. In the present instance, the sprocket openings 26 are provided by mechanical cutting dies 28 associated with the piercing apparatus 24, and the termination openings 20 are provided by a laser (not shown) also associated with the piercing apparatus 24.

Following creation of the termination openings 20 in substrate strip 18, a release liner strip 30 is continuously applied to the undersurface of the substrate 18 and is of such width and positioning to entirely cover the lower ends of both termination openings 20*a*, 20*b* of a pair. The release liner strip 30 may be any of a variety of materials which are capable of being temporarily adhered to the undersurface of substrate 18, one preferred example being neat tetrafluoroethylene, or tetrafluroethylene-coated flexible films or foils.

Following application of the release liner strip 30, the substrate strip 18 moves relatively past a station at which conductive material 22 is discharged from a dispenser 32 onto the upper surface of the substrate strip. A squeegee 34 is positioned immediately downstream of the dispenser 32. The conductive material 22 which is to fill the termination openings 20*a*, 20*b* is dispensed in a fluid form such that it may be pressed downwardly into the termination openings 20*a*, 20*b*. The conductive material 22 typically includes particulate carbon, various metals, and/or metalized insulating fibers having the desired conductive properties. The conductive particulate might, in an extreme case, be simply dry and in fluid form, as for instance powdered graphite. However, it is generally preferable to entrain the conductive material in a fluid vehicle which facilitates its insertion into the termination openings 20*a*, 20*b* by squeegee 34 and which may be subsequently cured in a known manner, as by some chemical reaction, microwave energy or preferably by a thermal curing operation such as heat lamps 36.

The fluid vehicle is conveniently provided by a polymer such as acrylic, epoxy resin, urethane, polyamide-imide or polyimide which, in combination with the entrained conductive particulate, exhibits a fluid property with a Brookfield viscosity in the range of 10,000–100,000 centipoise prior to curing and which generally solidifies and exhibits relatively low shrinkage upon curing. The low shrinkage is generally obtained by using a high-solids polymer solution.

In the conductive material 22 of the illustrated embodiment, the conductive particulate was silver powder and silver flake and the polymer was a 50-weight percent solution of polyamide-imide in NMP. The weight percentages of those constituents was 21.4 polymer solution; 73.9 silver powder; and 4.7 silver flake.

The squeegee 34 is configured and positioned such that it presses the conductive material 22 downwardly into the termination openings 20*a* and 20*b*. It will be appreciated that the conductive material 22 might be urged into the openings 20*a*, 20*b* by a roller or similar mechanism as an alternative, or supplement, to the squeegee 34 depicted. Thereafter, the heat lamps 36 provide the requisite thermal curing to remove volatile agents and render the conductive material 22*a*, 22*b* in a terminal openings 20*a*, 20*b* in substantially solid form.

After the terminal openings 20*a*, 20*b* have been filled with conductive material 22*a*, 22*b*, a suitable coating of resistive material 16 is then applied to the top surface of the substrate strip 18. The resistive material may be any of various types suitable for providing a continuous, relatively smooth coating which is resistant to heat and to some degree of mechanical deformation and provides the requisite electrical resistivity. Though the resistive material 16 might include various types of conductive plastics such as carbon or metal particles disposed in a polymer such as acrylic, epoxy resin, urethane, polyamide-imide, or polyimide, one such such conductive plastic which is particularly suitable is disclosed in copending application Ser. No. 07/264,605 entitled Resin Composition by Kenneth Brown and filed on even date herewith and assigned to the same assignee as the present application and incorporated herein by reference.

As with the conductive material 22, the resistive material 16 is of paste-like consistency having a Brookfield viscosity in the range of 10,000–100,000 centipoise when it issues from a dispenser 38. Immediately following issuance from dispenser 38, the resistive material 16 is spread, leveled and its thickness determined by a coating (doctor) blade 40 in a known manner. The thickness of the resistive coating 16 following the doctor blade is typically about 0.001 to 0.005 inches.

Following deposition of the film or coating of resistive material 16, it is cured in step-wise fashion. Firstly, a set of thermal curing lamps 42 set the resistive coating 16 to its partially imidized form. In this stage, the film is a polymer which is thermoplastic in nature and therefore somewhat moldable. Subsequently, the substrate strip 18 and the associated film of resistive material 16 is hot-pressed to thermally cure, densify and consolidate it. The hot pressing may be provided by press rollers 44 shown in vertical opposition, at least the upper one of which is heated and includes a highly polished surface. The pressure of rollers 44 is adjusted so that the film of resistive material 16 is subjected in the partially imidized form to a pressure of about 150 pounds per square inch. This operation determines the final thickness of the resistive coating 16 which is typically about 0.0005–0.001 inches.

Digressing for a moment in the process as described to this point, it should also be noted that the release liner strip 30 is removed from the substrate strip 18 at some location prior to the operation for curing the film of resistive material 16. As depicted in FIG. 1, the release liner strip 13 is removed following the curing and solidification of the conductive material 22 and the openings 20 and prior to, or a, the deposition of the coating of resistive material 16. The release liner 30 may be removed in a conventional manner, as by suitable slitting or peeling apparatus (not shown).

Following the curing of the film of resistive material 16 on substrate 18, the process continues as depicted on the lower level of the extension of FIG. 1. At that point a pressure-sensitive adhesive film 46 is applied to the undersurface of substrate strip 18. The adhesive film 46 serves, as will be hereinafter described, to affix the resistive element 10 to the ceramic substrate 12. The adhesive film 46 is typically comprised of an electrically insulating material capable of providing good adhesion between the undersurface of the film substrate 18 and the ceramic substrate 12. A preferred example of the pressure-sensitive adhesive film 46 would include silicone or acrylic pressure sensitive transfer adhesive film having a thickness of about 0.001 inches. Characteristically, the width of the strip of adhesive film 46 is at least as great as the diameter of the annular resistive element 10 to be formed downstream thereof. A rotating cutter 48 serves to cut apertures 50 in the adhesive film 46 prior to its application to the undersurface of substrate 18. The size, positioning and spacing of successive apertures 50 are such that they may expose the conductive material 22 in openings 20 for subsequent electrical connection. Correspondingly, the application of adhesive film 46 to the undersurface of substrate 18 is gaged and controlled such that the apertures 50 are in alignment with the openings 20*a*, 20*b* in substrate 18.

Following the application and curing of the resistive material 16 to the substrate film 18, and preferably also following the application of the adhesive film 46 to that substrate, a punch apparatus 52 or similar type of cutting apparatus is provided for forming openings 54 through the laminated layers including the resistive material 16, the substrate 18 and the adhesive film 46. The openings 54 are, in the present instance, of circular shape and define the inner diameter of the resistive element 10 ultimately formed. While punch apparatus 52 typically creates the openings 54 by a mechanical punching or cutting operation, it will be understood that other techniques including laser cutting through the lamination might also be employed.

Depicted next in FIG. 1 is a breaking device such as laser 56 for causing a break or separation at least in the resistive material 16. Laser 56 in the present embodiment burns away a portion of the film of resistive material 16 overlying substrate 18 to create a gap designated 58. The positioning and size of gap 58 in the film of resistive material 16 serves, following ultimate formation of the resistive element 10 in its annular form, to create an electrical discontinuity in the resistive track. The gap 58 is necessarily in that region between adjacent termination openings 20 in which the wiper 14 will generally not be operative. In most representative examples, the track of resistance material 16 is intended to be an annular segment of somewhat less than 360° but more than 180°. In one example the annular segment may be approximately 350°. In such example, the termination openings 20*a* and 20*b* and their included conductive material 22*a* and 22*b* will have a slightly greater angular spacing than the gap 58 so as to underlie the resistive track near its opposite ends. If, for instance, the gap 58 spans 10° of the resistive element 10, the termination openings 20*a* and 20*b* might have been spaced by 10°–15°. Though the break effected by laser 56 is shown as creating a gap 58 only in the resistance material 16, it will be appreciated that it might continue entirely through the substrate 18 and adhesive film 46 if desired.

As depicted in FIG. 1, a final definition is given to the shape of the resistive element 10 by cutting or punching it from the continuous strip by use of the punching apparatus 60. Punching apparatus 60 may be similar to that of punching apparatus 52 in that it punches or cuts through the laminated layers of resistance material 16, substrate 18 and adhesive film 46. In fact, the cutting or punching steps performed by apparatus 52 and 60 might be combined at a single station so long as accommodation is made for cutting the gap 58 in the resistive material 16 as by laser 56, preferably prior to the time the element 10 is separated from the continuous strip. The punching apparatus 60 makes a circumferential cut which defines the outer diameter of the resistive element 10. The resistive element 10 is then separated from the continuous strip either by mechanical action of the punching apparatus 60 or by the simple action of gravity following the circumferential cut, thus completing the formation of resistive element 10. Element 10 is thus provided in a readily usable form, as for mounting on substrate 12 as seen in FIG. 3.

Referring to FIG. 3, the resistive element 10 is seen from the underside prior to its being mounted on the ceramic substrate 12. Substrate 12 is relatively rigid and includes a pair of terminal leads 62*a* and 62*b* thereon. Terminal leads 62*a* and 62*b* include respective terminal pads 64*a* and 64*b*. The terminal pads 64*a* and 64*b* are positioned for alignment with the respective conductive material 22 in the respective termination openings 20*a* and 20*b* when resistive element 10 is mounted on substrate 12. The terminal leads 62*a*, 62*b* may be formed on or in the ceramic substrate 12 by any of various methods such as screen, offset or transfer printing metalizations; or decal-type applied metalizations; or even by swaging pins in openings extending through the substrate. In assembling resistive element 10 to substrate 12, it is desirable to place the drops of electrically conductive epoxy on the respective terminal pads 64*a* and 64*b* for facilitating separate electrical conduction with the respective terminations 22*a*, 22*b*. Correspondingly, the adhesive film 46 on the undersurface of resistive element 10 serves to affix that element to the substrate following the application of a modest pressure. In order to facilitate the alignment of the terminations 22*a*, 22*b* with the respective terminal pads 64*a*, 64*b*, it may be helpful to provide locating marks on the substrate 12 and/or the resistive element 10.

After the resistive element 10 has been affixed to the substrate 12, that subassembly may be further brought into cooperating engagement with a conventional wiper contact 14. Contact 14 is adapted to be rotated such that it traverses the arcuate surface of the track of resistive material 16, thus providing the essential portions of a potentiometer.

Although the track of resistive material 16 has been described as annular, or an annular segment, it will be understood that the invention might also be practiced to provide terminations through a substrate film in association with a linear resistive track. In such instance, the pair of termination openings and associated conductive material would be spaced at, or near, opposite ends of the linear track. Similarly, the film substrate would probably assume the same, or similar, linear shape, and the punching or cutting apparatus would require appropriate modification.

It should be understood that the invention is intended to include the situation in which the conductive material filling the termination openings and the resistive material forming the resistive coating are substantially one and the same. However, they will typically require successive steps since the former must be pressed into the termination openings and that removes most of the material from the substrate surface.

It should be understood that the invention is not limited to the particular embodiments shown and described herein, but that various changes and modifications may be made without departing from the spirit and scope of this novel concept as defined by the following claims.

I claim:

1. A method for making an electrically resistive element for mounting in an electrical resistor device for engagement with a relatively movable contact member, comprising the steps of:

(a) forming a pair of termination openings extending through a substrate of insulating material between opposite top and undersurfaces thereof;

(b) applying a release liner to the undersurface of said substrate;

(c) applying an electrically conductive medium in fluid form to the top surface of said substrate in sufficient quantity and in such manner as to insure filling said termination openings;

(d) applying a resistive coating to the top surface of said substrate, said resistive coating covering an area including both of said termination openings and being in contact with said conductive medium therein;

(e) removing said release liner from the undersurface of said substrate sufficiently to expose said conductive medium in said termination openings in said undersurface for eventual electrically conductive connection with terminal means associated with the electrical resistor device; and (f) shaping said resistive coating to provide a continuous resistive track having said pair of termination openings thereunder near respectively opposite ends thereof, said resistive track being adapted for engagement with a relatively movable contact member.

2. The method of claim 1, wherein said substrate is a plastic sheet and said step of forming said pair of termination openings in said substrate consists of either mechanically punching or laser piercing the plastic sheet.

3. The method of claim 1, wherein said electrically conductive medium comprises conductive particles in a vaporizable fluid vehicle and said step of applying said conductive medium to said substrate is followed by a further thermal curing step which causes the conductive medium in said termination openings to assume a substantially solid form.

4. The method of claim 1 wherein said release liner is removed entirely from the substrate to expose said conductive medium in said termination openings.

5. The method of claim 1 wherein said resistive coating is applied to a first area of the top surface of said substrate and said step of shaping said resistive coating to provide said resistive track comprises physically separating from said first area at least that part of the substrate and resistive coating defining said resistive track.

6. The method of claim 5, wherein said resistive track is an annular segment of less than 360°, said separating step removes a 360° annular portion of the substrate and resistive coating, and further including the step of breaking the electrical continuity of said 360° annular resistive coating to provide said resistive track of less than 360°.

7. The method of claim 6, wherein said step of breaking electrical continuity of said resistive coating comprises laser cutting at least said resistive coating.

8. The method of claim 5 wherein said substrate is plastic film, and further includes the steps of dispensing said plastic film in continuous strip form, forming successive pairs of the termination openings in the strip of plastic film, applying the release liner in strip form to the strip of plastic film, applying the resistive coating as a substantially continuous strip to the top surface of the strip of plastic film, removing the release liner strip entirely from the strip of plastic film and wherein said resistive element is separated from said continuous strip of plastic film by said step of separating from said first area at least that part of the substrate and resistive coating defining said resistive track.

9. The method of claim 8, wherein said resistive track is intended to be an annular segment of less than 360° and, prior to said step of separating said resistive element from said continuous strip of plastic film, the inner diameter of said resistive track is formed by the step of removing a circular core portion of the substrate and resistive coating.

10. The method of claim 9, wherein said separating step comprises the step of removing a 360° annular portion of the substrate and resistive coating, and further including the step of breaking the electrical continuity of said 360° annular resistive coating to provide said resistive track of less than 36°.

11. The method of claim 10, including the further step of affixing said plastic film substrate having said resistive track to a further rigid substrate, said further rigid substrate being substantially electrically nonconducting and having a pair of separate electrically-conductive terminal portions formed thereon, said terminal portions being arranged for respective conductive connection with said conductive medium in the respective said termination openings in said plastic film substrate, and including the step of conductively connecting said terminal portions on said rigid substrate with said conductive medium in the respective said termination openings.

12. The method of claim 11 wherein said resistive track on said plastic substrate is conductively affixed to said rigid substrate by selectively applying an electrically conductive adhesive therebetween.

* * * * *